US010939788B2

(12) United States Patent
Sauer et al.

(10) Patent No.: US 10,939,788 B2
(45) Date of Patent: Mar. 9, 2021

(54) RETAINING PLATE WITH IMPROVED SEALING

(71) Applicant: Eurofilters Holding N.V., Overpelt (BE)

(72) Inventors: Ralf Sauer, Overpelt (BE); Jan Schultink, Overpelt (BE)

(73) Assignee: EUROFILTERS HOLDING N.V., Overpelt (BE)

( * ) Notice: Subject to any disclaimer, the term of this patent is extended or adjusted under 35 U.S.C. 154(b) by 162 days.

(21) Appl. No.: 16/085,409

(22) PCT Filed: Mar. 16, 2017

(86) PCT No.: PCT/EP2017/056228
§ 371 (c)(1),
(2) Date: Sep. 14, 2018

(87) PCT Pub. No.: WO2017/158085
PCT Pub. Date: Sep. 21, 2017

(65) Prior Publication Data

US 2019/0045990 A1 Feb. 14, 2019

(30) Foreign Application Priority Data

Mar. 17, 2016 (EP) ..... 16160969

(51) Int. Cl.
*A47L 9/14* (2006.01)

(52) U.S. Cl.
CPC ..... *A47L 9/1454* (2013.01)

(58) Field of Classification Search
CPC ..... A47L 9/1436; A47L 9/1445; A47L 9/1454
See application file for complete search history.

(56) References Cited

U.S. PATENT DOCUMENTS

2007/0175817 A1 8/2007 Goldman
2009/0223190 A1 9/2009 Nauta et al.
2009/0272083 A1* 11/2009 Sauer ..... A47L 9/1454 55/373

(Continued)

FOREIGN PATENT DOCUMENTS

CN 101431930 5/2009
CN 101747596 A 6/2010

(Continued)

OTHER PUBLICATIONS

Lueger; Encyclopedia of the entire technology: Staple Fiber 600 (Neuschappe); downloaded from the Internet on Aug. 29, 2019 at http://www.zeno.orq/Lueger-1904/A/Stapelfaser; 1920; including English translation.

(Continued)

*Primary Examiner* — Robert Clemente
(74) *Attorney, Agent, or Firm* — Brinks Gilson & Lione

(57) ABSTRACT

The invention relates to a retaining plate (2) for a vacuum cleaner filter bag, comprising a base plate in which a passage opening (3) is formed, and a sealing flap (5) for sealing the passage opening (3), wherein the sealing flap (5) is sealed via an elastic element (7; 10) in the sealed position, and wherein a cover element (9) is provided which is connected to the base plate, the sealing flap (5) and/or the elastic element (7) and partially or completely covers the elastic element (7).

18 Claims, 4 Drawing Sheets

(56) References Cited

U.S. PATENT DOCUMENTS

Figure 1:
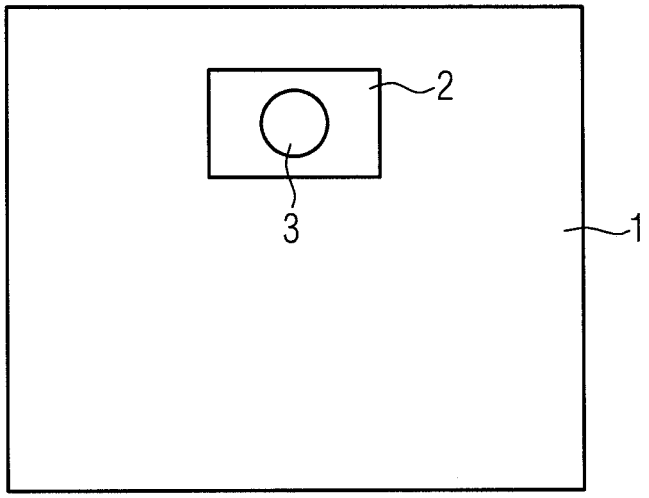

2011/0030557 A1 2/2011 Brownstein et al.

FOREIGN PATENT DOCUMENTS

| | | | |
|---|---|---|---|
| DE | DT 1 628 582 | | 2/1968 |
| DE | 90 16 939 | U1 | 5/1991 |
| DE | 44 15 350 | A1 | 11/1995 |
| DE | 296 15 163 | U1 | 1/1997 |
| DE | 2001 0049 | U1 | 10/2000 |
| DE | 199 19 809 | A1 | 11/2000 |
| DE | 199 48 909 | A1 | 4/2001 |
| DE | 102 03 460 | A1 | 8/2002 |
| DE | 10221694 | A1 | 12/2003 |
| DE | 20 2006 020 047 | U1 | 10/2007 |
| DE | 10 2006 037 456 | A1 | 2/2008 |
| DE | 10 2006 055 890 | A1 | 5/2008 |
| DE | 20 2008 003 248 | U1 | 6/2008 |
| DE | 20 2008 005 050 | U1 | 7/2008 |
| DE | 20 2008 004 733 | U1 | 11/2008 |
| DE | 10 2008 046 200 | A1 | 4/2009 |
| DE | 10 2007 062 028 | A1 | 6/2009 |
| DE | 20 2008 006 904 | U1 | 11/2009 |
| DE | 10 2008 041 227 | A1 | 2/2010 |
| DE | 20 2008 018 054 | U1 | 6/2011 |
| DE | 10 2010 060 175 | A1 | 3/2012 |
| DE | 10 2011 008 117 | A1 | 4/2012 |
| DE | 10 2010 060 353 | A1 | 5/2012 |
| DE | 10 2011 105 384 | A1 | 12/2012 |
| DE | 20 2013 001 096 | U1 | 4/2013 |
| DE | 20 2011 052 208 | U1 | 5/2013 |
| DE | 20 2013 100 862 | U1 | 5/2013 |
| DE | 10 2012 012 999 | A1 | 7/2013 |
| DE | 20 2013 103 508 | U1 | 10/2013 |
| DE | 10 2014 109 596 | A1 | 2/2015 |
| DE | 20 2015 101 218 | U1 | 5/2015 |
| DE | 20 2014 100 563 | U1 | 6/2015 |
| EP | 0 758 209 | A1 | 11/1995 |
| EP | 0 960 645 | A2 | 12/1999 |
| EP | 1 198 280 | A1 | 1/2001 |
| EP | 1 137 360 | A1 | 4/2001 |
| EP | 1 254 693 | A2 | 11/2002 |
| EP | 1258277 | A1 | 11/2002 |
| EP | 1 480 545 | A1 | 9/2003 |
| EP | 1 795 247 | A1 | 6/2007 |
| EP | 1 795 427 | A1 | 6/2007 |
| EP | 1917895 | B1 | 5/2008 |
| EP | 2004303 | B1 | 12/2008 |
| EP | 2 011 556 | A1 | 1/2009 |
| EP | 2 044 874 | A2 | 4/2009 |
| EP | 2 123 206 | A1 | 11/2009 |
| EP | 2 263 508 | A1 | 12/2010 |
| EP | 2 442 703 | A1 | 12/2010 |
| EP | 2 301 404 | A2 | 3/2011 |
| EP | 2 433 695 | A1 | 3/2012 |
| EP | 3 219 373 | A1 | 9/2017 |
| EP | 3 219 374 | A1 | 9/2017 |
| EP | 3 219 375 | A1 | 9/2017 |
| FR | 2 721 188 | A1 | 12/1995 |
| WO | WO 01/003802 | A1 | 1/2001 |
| WO | WO 03/073903 | A1 | 9/2003 |
| WO | WO 07/121979 | A1 | 11/2007 |
| WO | WO 11/047764 | A1 | 4/2011 |
| WO | WO 11/057641 | A1 | 5/2011 |
| WO | WO 13/106392 | A2 | 7/2013 |
| WO | WO 2014/074398 | A2 | 5/2014 |

OTHER PUBLICATIONS

East Bavarian Technical College: construction course in plastics technology East Bavarian Technical University Amberg-Weiden; Study content for the course of plastics technology; downloaded from the internet on May 23, 2019 at https://www.oth-aw.de/studiendaende-und-bildundsangbote/studienangebote/bachelor-studiengaenge/kunststofftechnik/aufbau/; 10 pages including English translation.

European Standard No. DIN EN 15347: Plastics, Recycled Plastics, Characterisation of Plastics Wastes, English Version; ICS 13.030.50; 83.080.01; Feb. 2008; 12 pages.

Shen, Li et al.; "Open-loop recycling: A LCA case study of PET bottle-to-fibre recycling"; Resources, Conservation and Recycling, vol. 55; Nov. 1, 2010; pp. 34-52.

International Search Report dated Jun. 28, 2017 for International Application No. PCT/EP2017/056228.

First Office Action dated Jun. 5, 2020, for International Chinese Application No. 201780025468.8 (11 pages) (English Translation).

* cited by examiner

RETAINING PLATE WITH IMPROVED SEALING

This application claims the benefit under 35 U.S.C. § 371 of International Application No. PCT/EP2017/056228, filed Mar. 16, 2017, which claims the priority of European Patent Application No. 16160969.8, filed Mar. 17, 2016, which are incorporated by reference herein in their entirety.

The invention relates to a retaining plate for a vacuum cleaner filter bag, in particular for arranging the vacuum cleaner filter bag in a vacuum cleaner housing.

Such retaining plates are known in a variety of forms. Many known retaining plates also feature sealing mechanisms, in which the passage opening can be sealed in the bag after use of the bag to prevent accidental leakage of suction material. Different solutions were proposed for the sealing mechanism, such as the sliding gate valve solutions in EP 0 758 209, the hinge [or pivot] solutions in DE 10 2011 105 384 or the membrane solutions in FR 2 721 188.

Solutions with so-called sealing flaps often use spring elements, which press or pull the sealing flaps into the sealing position after use. For instance, leaf springs, as disclosed in EP 2 123 206, curved leaf springs, as disclosed in EP 1 137 360, or helical steel springs, as disclosed in DE 10 2012 012 999, are applied. Other spring elements are known from DE 20 2013 100 862, DE 10 2008 046 200 and DE 10 2006 037 456.

The spring elements are often arranged in the filter bag, as disclosed in DE 10 2011 008 117 or DE 20 2015 101 218, but they can also be arranged outside of the filter bag, as disclosed in EP 1 480 545.

Solutions with automatic sealing mechanisms have proven themselves liable to fail, in particular if they are in the dust chamber. The sealing function is therefore not always secured during operation. The sealing flaps often remain partially open.

Therefore, the object of the invention is to provide a retaining plate that has a functionally reliable solution for sealing the passage opening, which can also be cost effectively mass-produced.

The object is solved by a retaining plate according to claim 1. Particularly advantageous embodiments can be found in the sub-claims.

The inventors of the present application have recognized that problems concerning the sealing function in known retaining plates can often be attributed to the fact that dust or other foreign particles accumulate in the area of the spring elements, such that they can no longer sufficiently apply pressure to the sealing flap with the necessary spring force. This invention prevents or reduces the deposit of such interfering elements by at least partially covering the elastic element with the cover element, and thus shielding it from the environment.

Hence, during operation no dirt particles or less thereof reach areas of the spring, wherein such dirt particles could negatively affect the function of the elastic element. This improves the functional reliability of the sealing mechanism. The solution is likewise easy to realize, such that it can also be implemented cost-effectively in a large-scale production.

The sealing flap is biased in the sealed position via the elastic element. This means that a force must be applied to open the sealing flap. This force can be exerted through a vacuum cleaner nozzle and/or the air stream flowing into the bag. When the sealing flap is in the open position, a force is applied to it via the elastic element in the sealing direction. This force causes the sealing flap to return to the sealing position after the force acting in the opening direction drops.

The sealing flap can be connected via a joint, in particular a film hinge, to parts of the retaining plate, in particular the base plate. The sealing flap can have a form that corresponds to the form of the passage opening.s Here "covering" is understood as shielding from the environment. In other words, the cover element separates the elastic element partially or completely from the environment. In other words, the cover element overlaps the elastic element at least partially on the side, on which the elastic element is arranged, when the retaining plate is viewed from above. The cover element thus covers one side of the elastic element, which points away from the part of the retaining plate, on which the elastic element is arranged.

The cover element can be spaced from the elastic element. In this case, the cover element overlaps the elastic element without touching it. However, it is also possible that the cover element contacts the elastic element, at least in certain areas and/or during parts of the opening and/or sealing movement of the sealing flap.

By means of the cover element in conjunction with the base plate and/or the sealing flap, a volume can be defined, within which the elastic element is partially or completely arranged. The cover element can thus be used to form a cavity to accommodate the elastic element.

The cover element can be arranged in such a way that, when the sealing flap is open, it does not overlap or cover the areas of the passage opening released by the flap (when viewed in the flow direction). In other words, the cover element can be arranged, so that it overlaps or covers the passage opening only in areas where these are also overlapped or covered by the sealing flap.

The maximum distance between the elastic element and a surface of the cover element facing the elastic element can be smaller than the diameter of the sealing flap, in particular smaller than half the diameter of the sealing flap. If the sealing flap does not have a constant diameter, the average diameter can be used as the diameter.

The elastic element can be any spring element, for example, a coil spring, a leg spring, a leaf spring or a cambered leaf spring.

The retaining plate can be attached to a retaining mechanism in a vacuum cleaner housing. Alternatively, the vacuum cleaner filter bag can be slidable by means of the retaining plate over a connecting nozzle on the vacuum cleaner side.

The elastic element can be positioned in front of the sealing flap when viewed in the sealing direction. In the opening direction, the elastic element is then arranged behind the sealing flap. In other words, the elastic element can therefore be arranged on the side of the retaining plate, which is intended to be connected to the bag wall of the vacuum cleaner filter bag. If the retaining plate is connected to a vacuum cleaner filter bag, the elastic element is located in the dust chamber, i.e. inside the vacuum cleaner filter bag. There the risk that the function of the elastic element is impaired by dirt particles is particularly high. Thus, the use of the cover element according to the invention is particularly advantageous here.

When the cover element completely covers the elastic element, the elastic element can be completely separated from the dust space.

If the cover element only partially covers the elastic element, areas of the elastic element in particular can be covered, in which dirt particles could lead to a reduction of the spring force in the sealing direction. Such effective areas may in particular be areas of the elastic element, which exert a spring force on the sealing flap, or areas directly adjacent to the fastening devices of the elastic element to parts of the retaining plate. In these storage areas, dirt particles can cause the distance between the elastic element and the sealing flap in the sealing position to increase. As a result, the elastic element can no longer provide the full spring force.

Alternatively or additionally, areas of the elastic element can be covered in which the elastic element interacts with retaining elements, which hold the elastic element in a predetermined position in the open and/or closed position of the sealing flap.

The cover element can comprise a film, a nonwoven and/or a paper. In particular, the film can be an elastic film, which, for example, comprises or consists of a thermoplastic elastomer. It is also conceivable that the cover element comprises a laminate of different materials, for example, comprising a nonwoven and a film or a paper and a film. It has been shown that such cover elements do not significantly impair the movement of the flap and the elastic element when opening and closing the sealing flap.

The cover element can be designed as a separate component that is detachably or non-destructively detachable to a part of the base plate, the sealing flap and/or the elastic element.

The cover element can be glued or welded to a part of the retaining plate, in particular to a part of the base plate. For welding, in particular ultrasonic welding can be used. However, it is also possible for the cover element to be molded onto a part of the retaining plate, in particular a part of the base plate. This is advantageously possible via a two-component injection molding process, in particular if the cover element contains or consists of an elastomer. A positive connection, for example in the form of a "Snap Fit" or a force-fitting connection, is also conceivable.

It is also possible that the cover element is only connected to the elastic element, in particular adhesively bonded thereto, connected in a form-locking or force-fitting manner.

The cover element can rest against the base plate and/or sealing flap in a surface area of the base plate and/or sealing flap which completely encloses the elastic element or at least on two sides. This can at least partially prevent suction material from reaching the side of the elastic element.

The cover element can have an embossing that is particularly adapted to the form of the elastic element. This means that the elastic element is even less restricted in its movement during the opening of the sealing flap.

For this purpose, the cover element can alternatively or additionally also be pleated or creped. For example, the cover element can take the form of a bellows. It is possible that the bellows encloses the elastic element only partially radially, for example only in the half-space that faces away from the base plate and/or sealing flap.

Embossing can be generated by hot or cold stamping or by forming, for example, deep drawing or vacuum forming. Ultrasonic embossing is particularly preferred. This procedure is particularly fast.

The cover element can also be an injection molded part or a deep-drawn part. This in turn can be connected to parts of the retaining plate in a material-locking, force-fitting or form-fitting manner.

The cover element can also be formed of multiple pieces. This can be advantageous if the material used for the cover element is relatively stiff.

Parts of the multi-piece cover element can be form-fitted or firmly bonded, for example, by welding, gluing or a "snap-fit" connection. However, it is also possible for the parts of the multi-piece cover element not to be connected to each other.

The cover element can also comprise a pivot axis, around which part of the cover element can be pivoted, in particular the pivot axis being formed by a film hinge. Also with this measure, the strength of the cover element can be taken into account.

The elastic element can comprise an elastomer or consist of an elastomer. The inventors of the present application have found that particularly when coil springs are used, suction material can also accumulate between the coils of the spring, which impairs the effect of the spring. If the elastic element comprises an elastomer or consists of an elastomer, this negative influence on the spring effect can be reduced or avoided.

The elastomer may include or be vulcanized silicone elastomer in particular. Crosslinked liquid silicone rubber (LSR) or crosslinked solid silicone (High-Consistency Rubber, HCR) are particularly suitable.

The elastic element can be designed in particular as an elastomeric cord or elastomeric band. The cross-section of the elastomeric cord or band can be round, rectangular or square. However, other cross-sections are also conceivable. It is also conceivable that the elastic element is in the form of a hollow cylinder, i.e. it is hollow along its longitudinal axis. Savings on material is thus possible.

If the elastic element comprises an elastomer or consists of an elastomer, it can also be molded onto part of the retaining plate, in particular part of the base plate.

Alternatively, it is possible that the elastic element is a coil spring, whereby the coil spring is at least partially enclosed by a sheath. In other words, the cover element can take the form of a sheath. In this case, the gaps between the coil springs in particular are protected from further pollution.

In this context, a sheath is a cover element, which completely encloses the elastic element radially, especially in the form of a coil spring. Along the longitudinal axis of the elastic element, the sheathing can extend completely or only partially over the entire extension of the elastic element.

A coil spring is a spring in which the spring wire is wound up as a coil. Along the longitudinal axis, the shape of the spring can be cylindrical or conical (conical spring). Springs that include a coil spring, such as leg springs, can also be regarded as coil springs. In this respect, coil springs are to be distinguished from spiral springs, in which a metal strip is wound in a plane curved helically or conchoidally.

The sheath may include plastic, non-woven and/or paper.

The term "nonwoven" is applied, according to the definition of the ISO Standard ISO9092:1988 or CEM Standard EN29092. In particular the terms "nonwoven" or "fleece" and "nonwoven fabric" in the field of manufacturing nonwovens are defined as follows and are likewise to be understood in the sense of the present invention. Fibers and/or filaments are used to produce a nonwoven fabric. The loose or loose and still unbound fibers and/or filaments are referred to as fleece or fiber fleece (web). By means of a so-called fleece-binding step, a nonwoven material of this type is finally produced, which has sufficient strength, for example, to be wound into rolls. In other words, a nonwoven is self-supporting due to bonding. (Details on the use of the definitions and/or processes described herein can also be found in the standard work Vliesstoffe [English: "Nonwoven Fabrics"] by W. Albrecht, H. Fuchs, W. Kittelmann, Wiley-VCH, 2000).

The sheath can consist of two films, in particular plastic films, between which the coil spring is arranged, whereby the area in which the spring is arranged, is enclosed by a circumferential weld seam.

The cover element described above can also be used to attach the elastic element to the retaining plate. In particular, the elastic element can rest loosely on the base plate and be limited by the cover element in its position to a predetermined area. For example, the elastic element can be restricted in its movement by the cover element in such a way that it can only assume positions in which the sealing flap can be subjected to the spring force. It is also conceivable that the elastic element is fixed in its position by the cover element. In this context, fixed in its position means that the elastic element cannot be moved relative to the retaining plate in the closed position of the sealing flap.

The retaining plate described above can be designed as one piece or multiple pieces. For example, the retaining plate may comprise a retaining mechanism and a separate sealing mechanism comprising the sealing flap. The sealing mechanism can be connected directly or indirectly to the retaining mechanism, for example via the bag wall of the vacuum cleaner filter bag and/or via a sealing membrane.

In the case of a multi-piece retaining plate, the base plate can also be multi-piece. For example, one part of the base plate may be part of the retaining mechanism, and another part may be part of the sealing mechanism.

The invention also provides a vacuum cleaner filter bag comprising a bag wall and a retaining plate as described above.

The retaining plate can therefore have one or more of the features mentioned above.

The bag wall of the vacuum cleaner filter bag can comprise one or more layers of filter material, in particular one or more nonwoven layers. Vacuum cleaner filter bags with such a bag wall made of several layers of filter material are known, for example, from EP 2 011 556 or EP 0 960 645. A wide variety of plastics can be used as the material for the nonwoven layers, for example, polypropylene and/or polyester. In particular, the layer of the bag wall that is to be connected to the retaining plate can be a nonwoven layer.

The bag wall can have a passage opening, in particular where the passage opening of the bag wall is aligned with the passage opening of the base plate. Through the passage opening in the base plate and the passage opening in the bag wall, an inlet opening can be formed through which the air to be cleaned can flow into the interior of the vacuum cleaner filter bag.

The invention also provides a method for the manufacturing a retaining plate according to claim 15.

The provision of the base plate and the sealing flap may include in particular the production of the base plate and the sealing flap by injection molding. It is also possible to form the base plate by deep drawing. In this case, the sealing flap can be formed by injection molding as a separate element and then connected directly or indirectly to the deep-drawn base plate.

The arrangement of the elastic element on the base plate and/or the sealing flap may comprise connecting the elastic element to the base plate and/or the sealing flap, in particular by ultrasonic welding, gluing, or by a force-fitting or form-fitting connection. Alternatively, the elastic element can be placed loosely on the base plate and/or the cover flap.

The connection of the cover element to a part of the retaining plate can be done as described above by gluing, welding or injection moulding in an injection moulding process. The cover element can be connected to the base plate, the cover flap and/or the elastic element.

The method may also include providing a separate cover member and subsequently connecting the cover member to a portion of the retaining plate.

Figure 2:
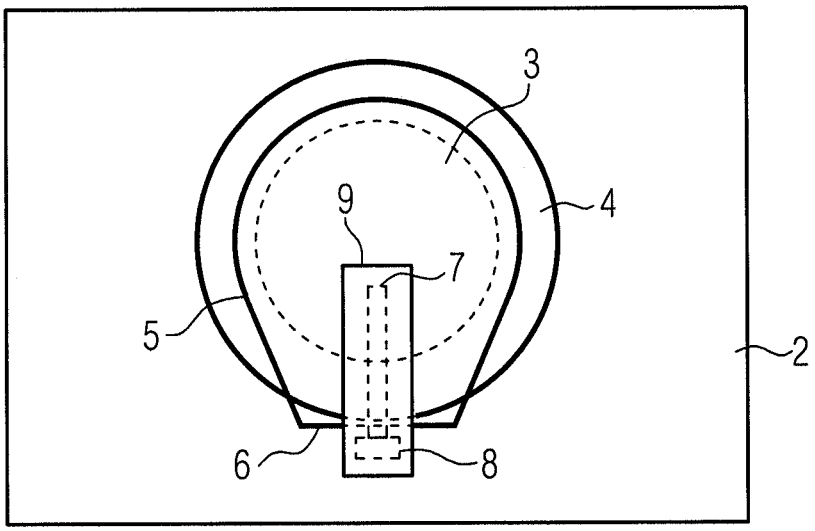
Figure 3:
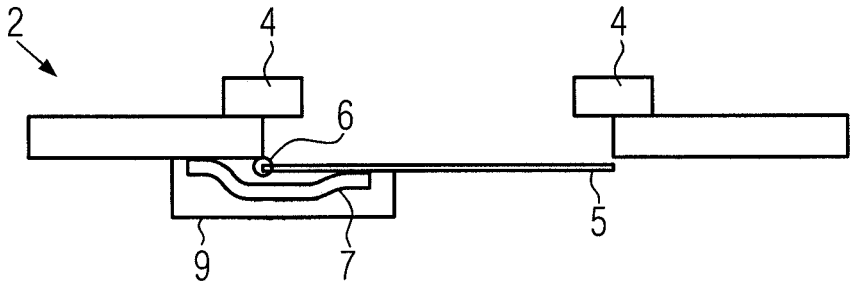
Figure 4A:
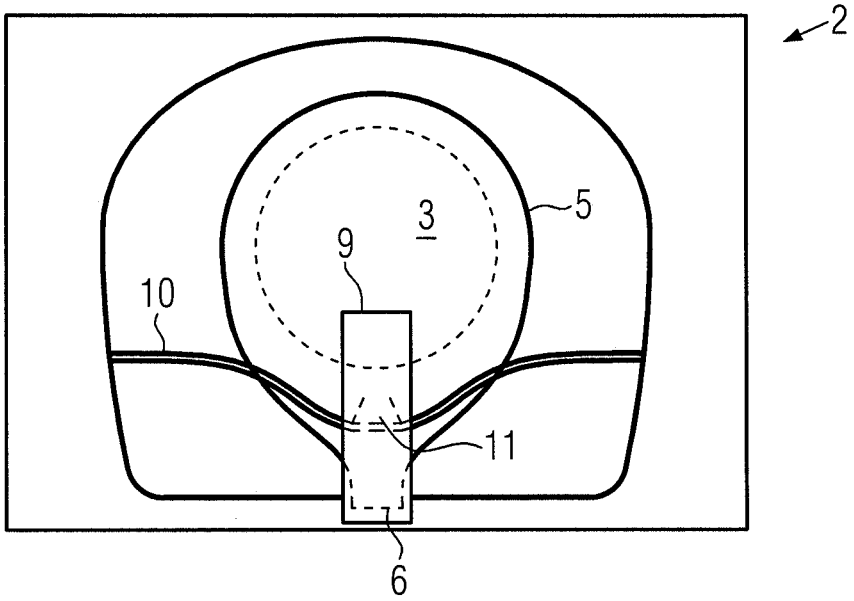
Figure 4B:
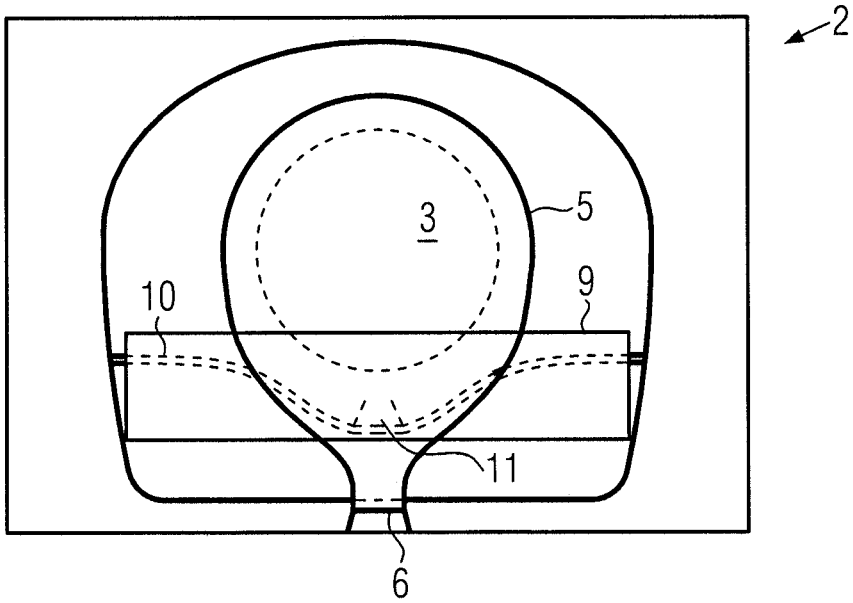

Further features and advantages are described below using the exemplary figures. Thereby showing:

FIG. 1 schematically the construction of an exemplary vacuum cleaner filter bag;

FIG. 2 the schematic structure of an exemplary retaining plate in a top view;

FIG. 3 a cross-section through an exemplary retaining plate;

FIGS. 4A and 4B a top view of further exemplary retaining plates; and

Figure 5:
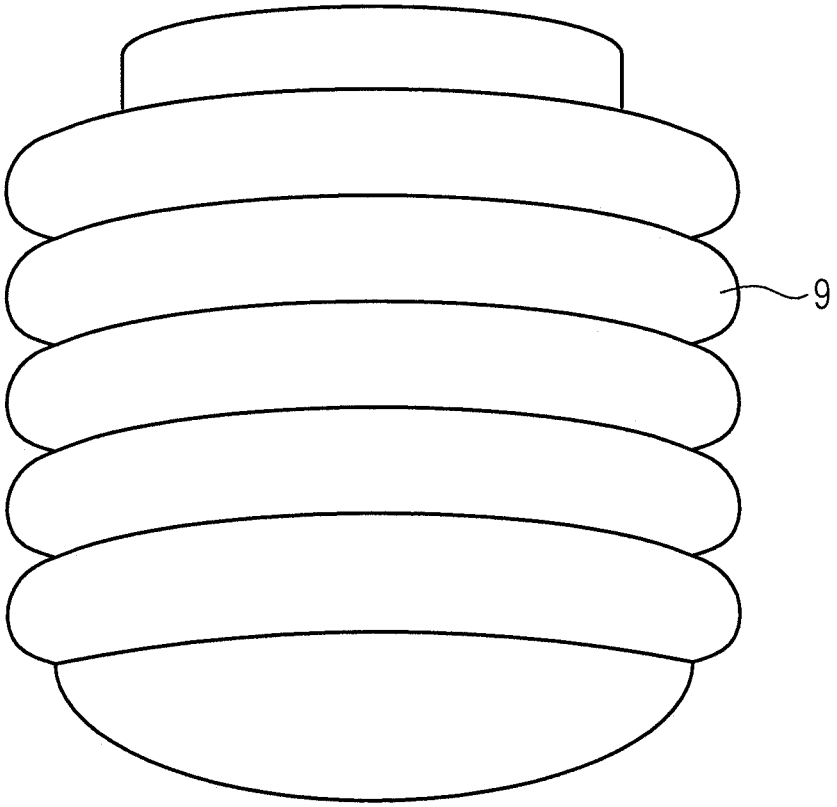

FIG. 5 a perspective view of an exemplary cover element.

FIG. 1 shows the schematic structure of an exemplary vacuum cleaner filter bag. The filter bag comprises a bag wall 1, a retaining plate 2 and an inlet opening, through which the air to be filtered flows into the filter bag. The inlet opening is formed here by a passage opening 3 in the base plate of retaining plate 2 and a passage opening in the bag wall 1 arranged in alignment therewith. The retaining plate 2 is used to fix the vacuum cleaner filter bag in a corresponding retaining mechanism in a vacuum cleaner housing.

The bag wall 1 comprises at least one nonwoven layer, for example, made of a melt-spun fine fiber nonwoven (melt-blown nonwoven) or a filament-spun nonwoven (spun bond).

The retaining plate 2 comprises a base plate made of a plastic material, for example polypropylene.

FIG. 2 shows a top view of an exemplary retaining plate, which can be used in conjunction with a filter bag as shown in FIG. 1. This shows the retaining plate 2 with the passage opening 3. The base plate of retaining plate 2 is shown here schematically rectangular, but it can have any shape, which can correspond in particular with the corresponding holding device in the vacuum cleaner housing.

FIG. 2 also shows a sealing lip 4 enclosing the passage opening 3. The sealing lip 4 can comprise a thermoplastic elastomer, for example, based on polypropylene, or consist of it. The sealing lip 4 is designed to prevent or limit the escape of dust from the vacuum cleaner filter bag by sealing the area between the inner edge of the passage opening 3 and the outside of a connection nozzle of the vacuum cleaner. However, the sealing lip shown here is merely optional. It is also conceivable that the bag material of the vacuum cleaner filter bag itself could be used as a sealing ring, as shown, for example, in DE 102 03 460. It is also possible to use a sealing membrane between retaining plate 2 and bag wall 1, as shown in EP 2 044 874. It can also be provided without any sealing.

FIG. 2 also shows a sealing flap 5, which can be pivoted around a joint 6. The hinge 6, in particular can be a film hinge. The sealing flap 5 seals the passage opening 3 when the vacuum cleaner is not in use, in particular when the filter bag is removed from the vacuum cleaner.

The sealing flap 5 is biased by an elastic element 7 in the sealing position. The elastic element 7 is connected to the base plate of the support plate 2 in the area of a bearing 8. In this example, the elastic element 7 is arranged in the sealing direction in front of the sealing flap 5. The top view of FIG. 2 is therefore on the side of the retaining plate 2, which is to be connected to the bag wall 1. After connecting the retaining plate 2 with the vacuum cleaner filter bag, the elastic element 7 is therefore located in the dust chamber, i.e. inside the filter bag.

The elastic element 7 can be a leaf spring, in particular a curved leaf spring, a coil spring or an elastomeric element. When the sealing flap 5 is pivoted around the joint 6 into an open position, the elastic element 7 is compressed and/or deflected in such a way that a resetting spring force is produced which is applied to the sealing flap 5. If the vacuum cleaner filter bag is removed from the vacuum cleaner housing, for example, the force opening the sealing flap 5 is omitted and the sealing flap 5 is returned to the closed position via the elastic element 7.

However, it has been found that the sealing function is not always ensured with known retaining plates, since dirt particles, in particular suction material, are disposed in the area of the elastic element 7 and hinder its function.

The retaining plate of FIG. 2 therefore also comprises a cover element 9, which is connected to the base plate of the retaining plate 2 and the sealing flap 5 and covers the elastic element 7 towards the dust chamber, i.e. away from the base plate of the retaining plate 2. This cover element 9 separates or shields the elastic element 7 from the dust chamber. As a result, no suction material or less thereof enters the area of the elastic element, in particular the area immediately adjacent to the bearing 8, so that its function is not impaired or less impaired.

It is also conceivable that the cover element 9 is only connected to the base plate and rests loosely on the sealing flap 5. A connection with the elastic element 7 is also alternatively or additionally possible.

The cover element may comprise a film, in particular an elastic film, for example made of a thermoplastic elastomer. The film may be less than 1 mm thick, in particular less than 0.5 mm, in particular less than 0.1 mm. It is also possible that the cover element 9 comprises or consists of a non-woven fabric, a paper or a woven tape. A laminate of different materials, such as nonwoven and film or paper and film, is also conceivable.

The cover element 9 can be detachably or non-destructively connected to the base plate and/or the sealing flap. For example, the cover element 9 can be glued or welded to the desired area of the base plate and/or the sealing flap. The cover element 9 can also have a self-adhesive area for the connection. A positive or non-positive connection is also possible, for example a "snap-fit" connection (click connection).

Finally, the cover element 9 can also be connected to the base plate and/or the cover flap 5 by means of an injection molding process. In this case, the cover element 9 can be injected simultaneously onto the retaining plate 2 with a sealing lip 4, if present In this case, the cover element 9 may be made of the same material as the sealing lip 4, in particular a thermoplastic elastomer. Such a two-component injection molding process eliminates the additional work involved in gluing or welding on the cover element 9.

In particular, if the cover element 9 comprises a film or a nonwoven, the film or the nonwoven can be embossed. This can give the cover element 9 a form that is adapted to the form of the elastic element 7, so that the movement of the elastic element 7 is not restricted or to a lesser extent during the opening of the sealing flap 5. Alternatively or additionally, cover element 9 can also be pleated or creped. For example, the cover element 9 can be in the form of a bellows. The folds of the pleated or creped cover element 9 can be in particular perpendicular to the direction of movement of the sealing flap and/or the elastic element.

Cover element 9 can be embossed by hot or cold stamping or by deep-drawing or vacuum deep-drawing.

Alternatively, the cover element 9 can also consist of an injection-molded part or a deep-drawn part, which is connected to the base plate, the sealing flap and/or the elastic element 7 in a material-locking, form-fitting or force-fitting manner, in particular by gluing or welding.

If the cover element 9 has a stiffness, which would oppose the mobility of the elastic element 7, the cover element 9 can also have a film hinge, around which part of the cover element 9 can be pivoted. Alternatively or additionally, the cover element 9 can be made in two or more pieces, whereby the parts of the multi-piece cover element are form-fitted or firmly bonded, especially by welding, gluing or clicking (snap-fit).

FIG. 3 shows a cross-section through the exemplary retaining plate 2 of FIG. 2, showing that the elastic element 7 is completely shielded from the dust chamber by the cover element 9, i.e. the environment, which lies inside the filter bag after connecting the retaining plate 2 with a filter bag.

The elastic element 7 can be a coil spring. In this case, a cover element in the form of a sheath may be provided as an alternative or in addition to cover element 9 of FIGS. 2 and 3. For example, the coil spring can be arranged at least partially in a plastic film tube. The sheathing can be easily formed by two plastic films which are welded together all around, with the coil spring located between the two films. Also a one-piece plastic hose can be pulled over the coil spring.

This plastic coating makes it possible to prevent dust from getting between the coils of the coil spring, which could lead to a reduction in the function of the coil spring.

As an alternative to the coil spring, the elastic element 7 can also be formed by an elastomeric cord or an elastomeric band. A vulcanized silicone elastomer in particular can be used for the elastic element. This has the advantage that it can be injected onto the retaining plate. Crosslinked liquid silicone rubber (LSR) or crosslinked solid silicone (High-Consistency Rubber, HCR) are particularly suitable. The elastic element made of an elastomer has its own elasticity. In addition, the elastic element can also have a form that lends further elasticity due to its structure.

FIG. 4A shows another example of a retaining plate 2 with sealing flap 5. In this case the elastic element 10 runs transversely to the opening movement of the sealing flap 5. The elastic element 10 can in turn take the form of a coil spring or an elastomeric strap. In this example, again a cover element 9 is provided, which in this case is connected to the cover flap 5, but only partially covers the elastic element 10. In particular, the cover element 9 in this example covers the area of the elastic element 10, which interacts with the sealing flap 5 via a projection 11. This area is the functional area for applying force to the sealing flap 5 via the elastic element 10. The projection 11 serves to hold the elastic element 10 in a holding position. If suction material were disposed in this area, the function of the projection 11 would be disrupted, and thus the function of the elastic element 10 as well.

FIG. 4B shows another example of an arrangement of a cover element 9, in which case, the cover element 9 must be absolutely elastic. In the open position of the sealing flap 5, the spring element should be covered as far as possible.

FIG. 5 shows an example of a possible cover element 9, which is in particular pleated, i.e. has several pleats in the sense of a bellows. While a bellows is usually tubular, the cover element 9 is rather dome-shaped. By folding, it is possible to provide a relatively firm cover element without significantly disrupting the mobility of the underlying elastic element.

It goes without saying that the features mentioned in the exemplary embodiments described above are not limited to these special combinations and are also possible in any other combinations. Furthermore, it goes without saying that neither the vacuum cleaner filter bag shown nor the elements of the retaining plate are realistically dimensioned in the figures. In addition, the geometries or the elements shown are not limited to the examples shown.

The invention claimed is:

1. A retaining plate for a vacuum cleaner filter bag, comprising a base plate in which a passage opening is formed, and a sealing flap for sealing the passage opening, wherein the sealing flap is biased in a closed position by an elastic element, and a cover element which is connected to one or more of the base plate, the sealing flap or the elastic element and which partially or completely covers the elastic element, wherein the cover element rests against the sealing flap in a surface area of the sealing flap, which encloses the elastic element at least on two sides.

2. The retaining plate according to claim 1, wherein the elastic element is arranged in front of the sealing flap as seen in a sealing direction.

3. The retaining plate according to claim 1, wherein the cover element comprises one or more of a film, a nonwoven or a paper.

4. The retaining plate according to claim 1, wherein the cover element is glued or welded to a part of the retaining plate or is molded onto a part of the retaining plate.

5. The retaining plate according to claim 1, wherein the cover element has an embossing, which is adapted to a shape of the elastic element.

6. The retaining plate according to claim 1, wherein the cover element is pleated or creped.

7. The retaining plate according to claim 1, wherein the cover element is of multi-piece construction.

8. The retaining plate according to claim 7, wherein parts of the multi-piece cover element are positively or materially connected to each other.

9. The retaining plate according to claim 1, wherein the cover element comprises a pivot axis about which a portion of the cover element is pivotable.

10. The retaining plate according to claim 1, wherein the elastic element comprises an elastomer or consists of an elastomer.

11. The retaining plate according to claim 10, wherein the elastic element is molded onto a part of the retaining plate.

12. The retaining plate according to claim 10, wherein the elastic element is molded onto the base plate.

13. The retaining plate according to claim 1, wherein the elastic element is a coil spring, and wherein the coil spring is at least partially enclosed by a sheath.

14. The retaining plate according to claim 1, wherein the elastic element rests loosely on the base plate and is limited in position to a predetermined area by the cover element.

15. A vacuum cleaner filter bag comprising a bag wall and a retaining plate connected thereto in accordance with claim 1.

16. The retaining plate according to claim 1, wherein the cover element is glued or welded to the base plate, or is molded onto the base plate.

17. The retaining plate according to claim 1, wherein the cover element comprises a pivot axis formed by a film hinge about which a portion of the cover element is pivotable.

18. A method of manufacturing a retaining plate for a vacuum cleaner filter bag, the method comprising:

providing a base plate with a passage opening and a sealing flap for sealing the passage opening;

disposing an elastic element on one or more of the base plate or the sealing flap; and connecting a cover element to one or more the base plate, the sealing flap or the elastic element so that the elastic element is partially or completely covered by the cover element, wherein the cover element is arranged such that it rests against the sealing flap in a surface area of the sealing flap, which encloses the elastic element at least on two sides.

* * * * *